US006973977B2

(12) United States Patent
Naquin

(10) Patent No.: US 6,973,977 B2
(45) Date of Patent: Dec. 13, 2005

(54) USING FLUIDS AT ELEVATED TEMPERATURES TO INCREASE FRACTURE GRADIENTS

(75) Inventor: Carey J. Naquin, Katy, TX (US)

(73) Assignee: Halliburton Energy Systems, Inc., Houston, TX (US)

( * ) Notice: Subject to any disclaimer, the term of this patent is extended or adjusted under 35 U.S.C. 154(b) by 90 days.

(21) Appl. No.: 10/639,137

(22) Filed: Aug. 12, 2003

(65) Prior Publication Data

US 2005/0034898 A1 Feb. 17, 2005

(51) Int. Cl.[7] ..... C09K 7/00
(52) U.S. Cl. ..... 175/50; 175/38; 175/72
(58) Field of Search ..... 175/5, 19, 38, 175/40, 50, 65, 72

(56) References Cited

U.S. PATENT DOCUMENTS

| | | | | |
|---|---|---|---|---|
| 5,615,115 | A | 3/1997 | Shilling | |
| 6,427,125 | B1 * | 7/2002 | Gzara et al. | 702/9 |
| 2003/0066650 | A1 | 4/2003 | Fontana et al. | |
| 2003/0079912 | A1 | 5/2003 | Leuchtenberg | |
| 2003/0121663 | A1 | 7/2003 | Weng et al. | |
| 2003/0127230 | A1 | 7/2003 | von Eberstein, Jr. et al. | |
| 2003/0146001 | A1 | 8/2003 | Hosie et al. | |

OTHER PUBLICATIONS

Schmidt, Joe, Gonzales, Manuel E., Bloys, Ben, and Pepin, Greg; "Method and System for Minimizing Circulating Fluid Loss during Drilling of a Well Bore by Using a Heated Circulating Fluid", [online]. retrieved from the Internet: <URL: https://priorart.ip.com/viewPub.jsp, (May 2002).

Lofton, John; Schmidt, Joe; Gonzales, Manny; Bloys, Ben and Pepin, Greg, "Mud Temperature Effects on Lost Returns for Deepwater Wells", May 2002.

* cited by examiner

*Primary Examiner*—Zakiya Walker
(74) *Attorney, Agent, or Firm*—Conley Rose, P.C.

(57) ABSTRACT

A method for drilling a wellbore in a formation using a drilling fluid, wherein the drilling fluid has a first temperature, and wherein the wellbore has a first wellbore depth. In one embodiment, the method comprises determining at least one fracture gradient, wherein the fracture gradient is determined at about the first wellbore depth; increasing the temperature of the drilling fluid from the first temperature to a desired temperature at about the first wellbore depth; drilling into the formation at increasing wellbore depths below the first wellbore depth, wherein at least one equivalent circulating density of the drilling fluid is determined at about the first wellbore depth; and setting a casing string at a depth at which the equivalent circulating density is about equal to or within a desired range of the fracture gradient. In other embodiments, an automated system is used to maintain the temperature of the drilling fluid at about first wellbore depth.

88 Claims, 3 Drawing Sheets

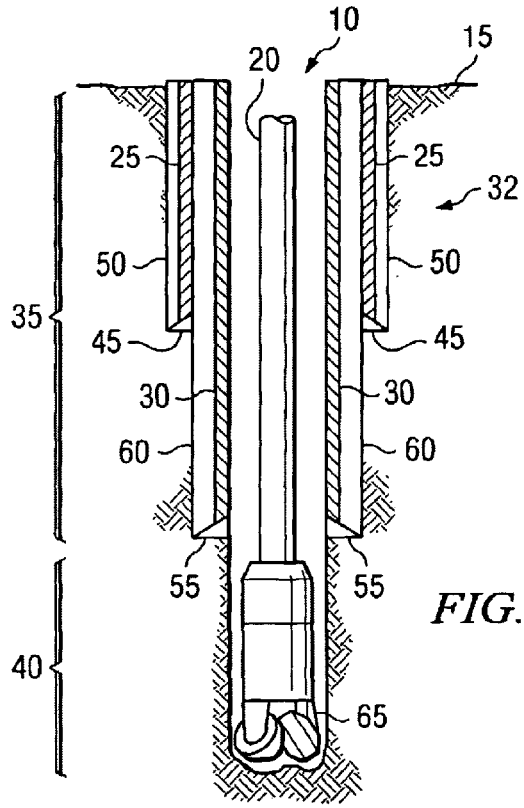
FIG. 1
FIG. 2
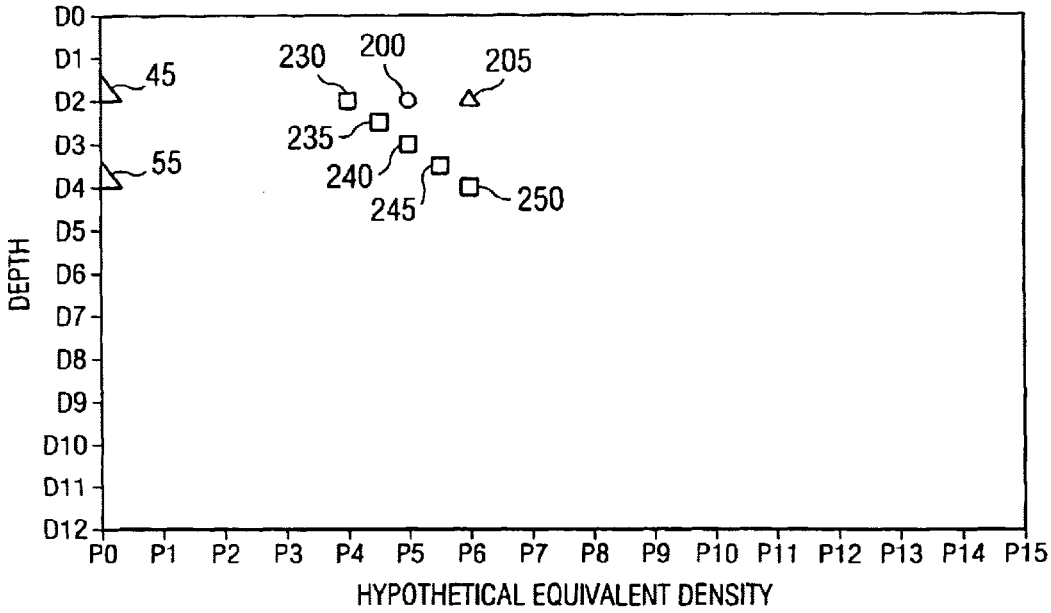

USING FLUIDS AT ELEVATED TEMPERATURES TO INCREASE FRACTURE GRADIENTS

BACKGROUND OF THE INVENTION

1. Field of the Invention

This invention relates to the field of drilling wellbores and more specifically to the field of using drilling fluids at elevated temperatures to increase fracture gradients in a wellbore.

2. Background of the Invention

In the drilling industry, a drilling fluid is typically used when drilling a wellbore. The drilling fluid may be used to provide pressure in the wellbore, clean the wellbore, cool and lubricate the drill bit, and the like. The wellbore may comprise a cased portion and an open portion. The open portion extends below the last casing string, which may be cemented to the formation above a casing shoe. In standard operations, the drilling fluid is circulated into the wellbore through the drill string. The drilling fluid returns to the surface through the annulus between the wellbore wall and the drill string. The pressure of the drilling fluid flowing through the annulus acts on the open wellbore. The drilling fluid flowing up through the annulus carries with it cuttings from the wellbore and any formation fluids that may enter the wellbore.

The drilling fluid may be used to provide sufficient hydrostatic pressure in the well to prevent the influx of such formation fluids. Typically, the density of the drilling fluid is controlled in order to provide the desired downhole pressure. The formation fluids within the formation provide a pore pressure, which is the pressure in the formation pore space. When the pore pressure exceeds the pressure in the open wellbore, the formation fluids tend to flow from the formation into the open wellbore. Therefore, the pressure in the open wellbore is typically maintained at a higher pressure than the pore pressure. The influx of formation fluids into the wellbore is called a kick. Because the formation fluid entering the wellbore ordinarily has a lower density than the drilling fluid, a kick may potentially reduce the hydrostatic pressure within the wellbore and thereby allow an accelerating influx of formation fluid. If not properly controlled, this influx may lead to a blowout of the well. Therefore, the formation pore pressure typically comprises the lower limit for allowable wellbore pressure in the open wellbore, i.e. uncased borehole.

While it is highly advantageous to maintain the wellbore pressures above the pore pressure, if the wellbore pressure exceeds the formation fracture pressure, a formation fracture may occur. With a formation fracture, the drilling fluid in the annulus may flow into the fracture, decreasing the amount of drilling fluid in the wellbore. In some cases, the loss of drilling fluid may cause the hydrostatic pressure in the wellbore to decrease, which may in turn allow formation fluids to enter the wellbore. Therefore, the formation fracture pressure typically defines an upper limit for allowable wellbore pressure in an open wellbore. Typically, the formation immediately below the casing shoe will have the lowest fracture pressure in the open wellbore. Consequently, such fracture pressure immediately below the casing shoe is often used to determine the maximum annulus pressure. However, in other instances, the lowest fracture pressure in the open wellbore occurs at a lower depth in the open wellbore than the formation immediately below this casing shoe. In such an instance, pressure at this lower depth may be used to determine the maximum annulus pressure.

Pore pressure gradients and fracture pressure gradients as well as pressure gradients for the drilling fluid have been used to determine setting depths for casing strings to avoid pressures falling outside of the pressure limits in the wellbore. These pressure gradients represent a plurality of respective pore, fracture, and drilling fluid pressures versus depth in the wellbore. Typically, the fracture pressure is determined by performing a leak-off test below a casing shoe by applying surface pressure to the hydrostatic pressure in the wellbore. The fracture pressure is the point where a formation fracture initiates as indicated by comparing changes in pressure versus volume during the leak-off test. Typically, a leak-off test is performed immediately after circulating the drilling fluid. The circulating temperature is the temperature of the circulating drilling fluid, and the static temperature is the temperature of the formation.

Typically, circulating temperatures are lower than static temperatures. A fracture pressure determined from a leak-off test performed when circulating temperatures just prior to performing the test are less than static temperature is lower than a fracture pressure if the test were performed at static temperature. This is due to the changes in near wellbore formation stress resulting from the lower circulating temperature as compared to the higher static temperature. Similarly, for a circulating temperature higher than static temperature, the fracture pressure determined from a leak-off test would be higher than if the test would be performed at static temperature.

For any given open hole interval, the range of allowable fluid pressures lies between the pore pressure gradient and the fracture pressure gradient for that portion of the open wellbore between the deepest casing shoe and the bottom of the well. The pressure gradients of the drilling fluid may depend, in part, upon whether the drilling fluid is circulated, which will impart a dynamic pressure, or not circulated, which may impart a static pressure. Typically, the dynamic pressure comprises a higher pressure than the static pressure. Thus, the maximum dynamic pressure allowable tends to be limited by the fracture pressure. A casing string must be set or fluid density reduced when the dynamic pressure exceeds the fracture pressure if fracturing of the well is to be avoided. Since the fracture pressure is likely to be lowest at the highest uncased point in the well, the fluid pressure at this point is particularly relevant. In some instances, the fracture pressure is lowest at lower points in the well. For instance, depleted zones below the last casing string may have the lowest fracture pressure. In such instances, the fluid pressure at the depleted zone is particularly relevant.

When drilling a well, the depth of the initial casing strings and the corresponding casing shoes may be determined by the formation strata, government regulations, pressure gradient profiles and the like. The initial casing strings may comprise conductor casings, surface casings, and the like. The fracture pressures may limit the depth of the casing strings to be set below the casing shoe of the first initial casing string. These casing strings below the initial casing strings are intermediate casing strings and the like. To determine the maximum depth of the first intermediate casing string, a maximum initial drilling fluid density may be initially chosen with the circulating drilling fluid temperature lower than static temperature, which provides a dynamic pressure that does not exceed the fracture pressure at the first casing shoe. The maximum drilling fluid density may also be used to compare the static and/or dynamic pressure gradient to the pore pressure and fracture pressure gradients to indicate an allowable pressure range and a depth at which the casing string should be set. After the first intermediate casing string is set, the maximum density of the drilling fluid can be increased to a pressure at which the dynamic pressure does not exceed the fracture pressure at the casing shoe of the newly set casing string. Such new maximum drilling fluid density may then be used to again compare the static and/or dynamic pressure gradient to the pore pressure and fracture pressure gradients to indicate an allowable pressure range and a depth at which the next casing string should be set. Such procedures are followed until the desired wellbore depth is reached. Drawbacks to this technique using circulating drilling fluid temperatures lower than static temperature include the fact that a large number of casing strings are required to be set in the wellbore. The number of casing strings tends to increase the cost of drilling the well. In addition, the diameter of the wellbore is reduced with each successive casing string. Such reduction in size limits the size of the equipment that can be passed through the casing string.

Consequently, there is a need to safely and efficiently use fewer casing strings when drilling a well. Further, there is a need to increase the fracture pressure gradients. Additional needs comprise using increased fracture pressure gradients to increase the intervals between casing strings and limiting the loss of drilling fluids to the formation.

BRIEF SUMMARY OF SOME OF THE PREFERRED EMBODIMENTS

These and other needs in the art are addressed in one embodiment by a method for drilling a wellbore in a formation using a drilling fluid, wherein the drilling fluid has a first temperature, and wherein the wellbore has a first wellbore depth, the method comprising: (A) determining at least one fracture gradient, wherein the fracture gradient is determined at about the first wellbore depth; (B) increasing the temperature of the drilling fluid from the first temperature to a desired temperature at about the first wellbore depth; (C) drilling into the formation at increasing wellbore depths below the first wellbore depth, wherein at least one equivalent circulating density of the drilling fluid is determined at about the first wellbore depth; and (D) setting a casing string at a depth at which the equivalent circulating density is about equal to or within a desired range of the fracture gradient.

In another embodiment, the invention provides a method for drilling a wellbore in a formation using a drilling fluid to increase fracture gradients, wherein a last casing string and a last casing shoe are disposed in the wellbore, the method comprising: (A) determining at least one fracture gradient at about the last casing shoe, wherein an initial fracture gradient is determined at a conventional drilling fluid temperature; (B) drilling into the formation below the last casing shoe at increasing depths with the drilling fluid at about the conventional drilling fluid temperature at about the last casing shoe, and wherein at least one equivalent circulating density of the drilling fluid is determined at about the last casing shoe; (C) increasing the temperature of the drilling fluid at about the last casing shoe to a desired drilling fluid temperature; (D) drilling further into the wellbore at increasing depths with the drilling fluid at about the desired temperature at about the last casing shoe, wherein at least one equivalent circulating density of the drilling fluid is calculated at about the last casing shoe; and (E) setting a next casing string that extends from the last casing string to a depth at which the equivalent circulating density at about the last casing shoe is about equal to or within a desired range of a fracture gradient determined at about the last casing shoe.

In a third embodiment, the invention provides for a method for drilling a wellbore in a formation using a drilling fluid, wherein a last casing string and a last casing shoe are disposed in the wellbore, wherein the drilling fluid has a first temperature, the method comprising: (A) increasing the temperature of the drilling fluid to a desired temperature at about the last casing shoe; (B) determining at least one fracture gradient at the desired temperature, wherein the fracture gradient is determined at about the last casing shoe; (C) drilling into the formation at increasing wellbore depths below the last casing shoe, wherein at least one equivalent circulating density of the drilling fluid is calculated at about the last casing shoe; and (D) setting a next casing string at a depth at which the equivalent circulating density is about equal to or within a desired range of a fracture gradient determined at about last casing shoe.

In a fourth embodiment, the invention provides for a method for drilling a wellbore in a formation using a drilling fluid to increase fracture gradients, wherein a last casing string and a last casing shoe are disposed in the wellbore, the method comprising: (A) determining at least one fracture gradient at about the last casing shoe, wherein an initial fracture gradient is determined at a conventional drilling fluid temperature, (B) drilling into the formation below the last casing shoe at increasing depths with the drilling fluid at about the conventional drilling fluid temperature at about the last casing shoe, and wherein at least one equivalent circulating density of the drilling fluid is determined at about the last casing shoe; (C) increasing the temperature of the drilling fluid at about the last casing shoe to an elevated drilling fluid temperature; (D) drilling further into the wellbore at increasing depths with the drilling fluid at about the elevated temperature at about the last casing shoe, wherein at least one equivalent circulating density of the drilling fluid is calculated at about the last casing shoe; (E) increasing the temperature of the drilling fluid at about the last casing shoe to a super-static drilling fluid temperature; (F) drilling further into the wellbore at increasing depths with the drilling fluid at about the super-static temperature at about the last casing shoe, wherein at least one equivalent circulating density of the drilling fluid is calculated at about the last casing shoe; and (G) setting a next casing string that extends from the last casing string to a depth at which the equivalent circulating density at about the last casing shoe is equal to or within a desired range of a super-static fracture gradient determined at about the last casing shoe.

In a fifth embodiment, the invention provides for a method for drilling a wellbore in a formation using a drilling fluid to increase fracture gradients, wherein a last casing string and a last casing shoe are disposed in the wellbore, wherein the drilling fluid has a first temperature, the method comprising: (A) increasing the temperature of the drilling fluid to an elevated temperature at about the last casing shoe; (B) determining at least one fracture gradient at about the last casing shoe, wherein at least one elevated fracture gradient is determined; (C) drilling into the formation below the last casing shoe at increasing depths with the drilling fluid at about the elevated temperature at about the last casing shoe, and wherein at least one equivalent circulating density of the drilling fluid is determined at about the last casing shoe; (D) increasing the temperature of the drilling fluid at about the last casing shoe to a super-static temperature; (E) drilling further into the wellbore at increasing depths with the drilling fluid at about the super-static temperature at about the last casing shoe, wherein at least one equivalent circulating density of the drilling fluid is calculated at about the last casing shoe; and (F) setting a next casing string that extends from the last casing string to a depth at which the equivalent circulating density at about the last casing shoe is equal to or within a desired range of a super-static fracture gradient determined at about the last casing shoe.

In alternative embodiments, leak-off-tests are used to determine at least one fracture gradient. Further embodiments include using an automated system to maintain the drilling fluid temperature at about the last casing shoe.

It will therefore be seen that the technical advantages of this invention include drilling wellbores at deeper intervals and with fewer casing strings, thereby eliminating problems encountered by drilling a wellbore using the initial fracture gradient to set the casing strings. For instance, using the initial fracture gradient causes additional casing strings to be set. Additional casing strings reduce the diameter in the wellbore. Further advantages include increasing the fracture gradient in the wellbore to enable the drill string to drill at deeper depths between casing strings. The invention prevents fracturing of the wellbore during drilling between such deeper casing strings and thereby prevents loss of drilling fluids to the formation and introduction of formation fluids to the wellbore. In addition, the invention allows a deeper wellbore to be drilled between casing strings without decreasing safety.

The disclosed devices and methods comprise a combination of features and advantages which enable it to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which:

FIG. 1 illustrates a wellbore having casing strings and a drill string;

FIG. 2 illustrates a hypothetical equivalent density v. wellbore depth profile showing an initial fracture gradient and an elevated fracture gradient;

DETAILED DESCRIPTION OF THE PREFERRED EMBODIMENTS

Figure 3:
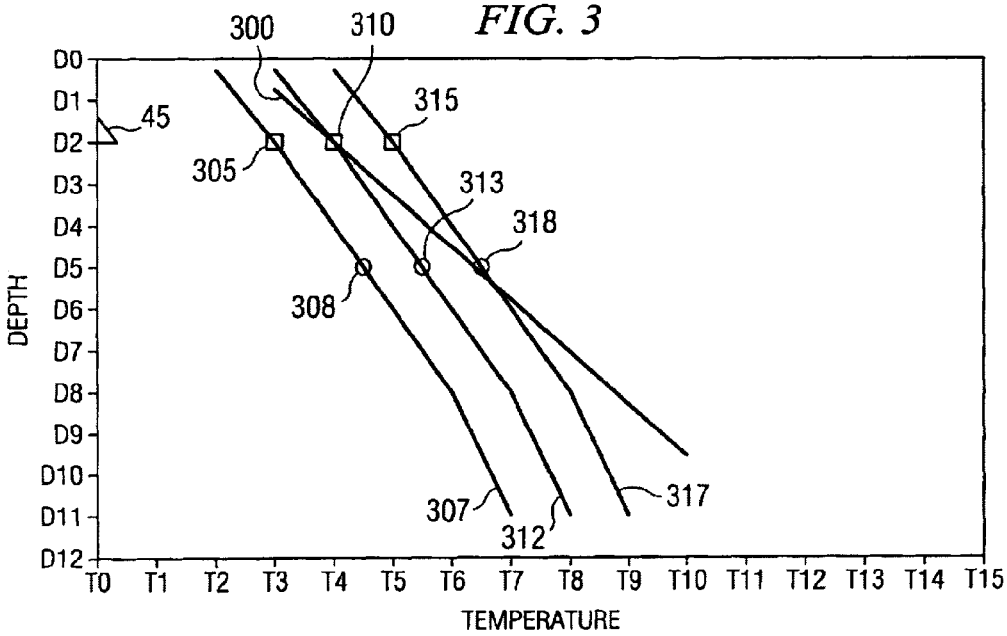
FIG. 3 illustrates a hypothetical temperature v. wellbore depth profile showing drilling fluid temperatures and a static temperature profile.

FIG. 1 illustrates a wellbore 10 being drilled from a surface 15 and having a drill string 20, a last casing string 25, and a next casing string 30. Wellbore 10 is drilled into a formation 32. Wellbore 10 preferably comprises a cased wellbore section 35 and an open wellbore section 40. Cased wellbore section 35 comprises the portion of wellbore 10 in which casing strings 25 and 30 have been set. Open wellbore section 40 comprises an uncased section of wellbore 10. Last casing string 25 may comprise a surface casing string. Next casing string 30 may comprise an intermediate casing string. Alternatively, last casing string 25 and/or next casing string 30 may bottom of last casing string 25. Last casing string 25 may be secured to formation 32 by a last cement section 50, which is disposed in the annulus between formation 32 and last casing string 25. In alternative embodiments (not illustrated), additional casing strings, such as structural conductor casing strings, and the like, may be disposed in wellbore 10 between surface 15 and last casing string 25. Next casing shoe 55 is preferably disposed at the bottom of next casing string 30. Next casing string 30 may be secured to formation 32 by a next cement section 60 disposed in the annulus between formation 32 and next casing string 30. Drill string 20 may comprise a drill bit 65, sub, or the like, such as are known in the art. The tubing comprising drill string 20 is likewise well known in the art. The tubing may include coiled tubing, jointed tubing and any other suitable tubing. It is to be understood that the present invention can be used for off-shore and on-shore operations.

FIG. 2 illustrates a hypothetical equivalent density v. wellbore depth profile in which an initial fracture gradient 200 and an elevated fracture gradient 205 are represented. Each fracture gradient represents the pressure that would need to be exerted by the drilling fluid at given wellbore depths in order to fracture formation 32. In accordance with convention, the gradients are expressed as the density of the drilling fluid that exerts such a pressure. Last casing shoe 45 is represented at a depth of D2. Likewise, next casing shoe 55 is represented at a depth of D4. The individual points on FIG. 2 are representations of the determined equivalent circulating densities ("ECDs") of drilling fluid at about last casing shoe 45 at about a depth of D2. The ECDs reflect the effective density exerted by the circulating drilling fluid against formation 32 at a depth of D2 for a given fluid density when the pressure drop in the annulus is taken into account. Thus, points 230, 235, 240, 245 and 250 represent the ECDs for a circulating fluid at last casing shoe 45 at about a depth of about D2 in a wellbore of increasing depth. For instance, point 240 represents the ECD at about last casing shoe 45 at a depth of D2 when drill bit 65 is drilling at a depth of D3. Determination of ECDs is well known in the art, and the ECDs of the present invention can be determined in any known manner. It is to be understood that the ECDs are not limited to being determined approximately at about last casing shoe 45. One skilled in the art would know that determining fracture gradients at about a casing shoe includes depths below the casing shoe, preferably depths from about 10 to about 20 feet below the casing shoe. The densities, depths, ECDs, and fracture gradient designations are representative only and do not limit the invention.

FIG. 3 illustrates a hypothetical temperature v. wellbore depth profile in which a hypothetical static temperature profile 300 and a plurality of drilling fluid temperature profiles 307, 312, and 317 are represented. Static temperature profile 300 illustrates a typical geothermal temperature gradient for formation 32, wherein the static temperature increases with increasing wellbore depth. Determination of static temperature profiles is well known in the art, and the static temperature profile of the present invention can be determined in any known manner.

Each drilling fluid temperature profile represents the temperature of the drilling fluid at increasing wellbore depths. More specifically, FIG. 3 illustrates a conventional drilling fluid temperature profile 307, an elevated drilling fluid temperature profile 312, and a super-static drilling fluid temperature profile 317. Points 305, 310, and 315 respectively represent three different temperatures of the drilling fluid at about last casing shoe 45 at a depth of D2. Conventional drilling fluid temperature profile 307 plots the temperature of the drilling fluid, which results from circulation of the drilling fluid, at different depths in wellbore 10 when drilling fluid is introduced into wellbore 10 at the conventional temperature. For instance, point 308 represents the drilling fluid temperature at a wellbore depth D5. Elevated drilling fluid temperature profile 312 plots the temperature of the drilling fluid, which results from circulation of the drilling fluid, at different depths in wellbore 10 when the drilling fluid temperature at about last casing shoe 45 is increased to a point that intersects static temperature profile 300 at about last casing shoe 45, which is represented by point 310. For instance, point 313 represents the drilling fluid temperature at a wellbore depth D5 when the drilling fluid temperature at about last casing shoe 45 is elevated to the temperature indicated by point 310. Similarly, super-static drilling fluid temperature profile 317 plots the temperature of the drilling fluid, which results from circulation of the drilling fluid, at different depths in wellbore 10 when the drilling fluid temperature at about last casing shoe 45 is increased to a desired temperature above static temperature profile 300 at about last casing shoe 45. Point 315 represents such a desired super-static temperature. For instance, point 318 represents the drilling fluid temperature at a depth of D5 when the drilling fluid temperature at about last casing shoe 45 is set to the temperature indicated by point 315. The depths and temperature designations are representative only and do not limit the invention.

Still referring to FIG. 3, point 305 represents the conventional temperature of the drilling fluid when the drilling fluid, which results from circulation of the drilling fluid, has typically been introduced into wellbore 10 at ambient conditions at surface 15 without increasing the drilling fluid temperature. Before drilling commences below last casing shoe 45, the conventional temperature of the drilling fluid at about last casing shoe 45 is typically less than the static temperature at about last casing shoe 45. The determination of the drilling fluid temperature at a desired depth is well known in the art. For instance, temperature sensors; thermodynamic, heat and mass transfer calculations; and the like may be used to determine the drilling fluid temperature.

The following describes an exemplary application of the present invention as embodied and illustrated in FIGS. 1, 2, and 3. To drill below last casing shoe 45, drill string 20 is lowered into wellbore 10 to last casing shoe 45. The drilling fluid may then be pumped into wellbore 10 and circulated. The temperature of the drilling fluid is determined at about the depth of last casing shoe 45 and is represented by point 305, which comprises the conventional drilling fluid temperature. A leak-off-test may then be performed at about last casing shoe 45 for the purpose of obtaining an initial fracture gradient 200, preferably the leak-off-test is performed from about 10 to about 20 feet below the last casing shoe 45. Leak-off-tests are well known in the art. For instance, a leak-off-test may comprise using drilling fluid to apply pressure to the closed-in wellbore 10. The drilling fluid volume versus pressure in wellbore 10 is recorded. When the recorded drilling fluid volume versus pressure in wellbore 10 deviates, the wellbore 10 may be assumed to be at its fracture point, and the fracture pressure may be determined. The invention is not limited to determining fracture gradients from leak-off tests, but includes determining fracture gradients by any known manner, such as the Eaton, Matthews & Kelly, and geomechanical analysis methods and the like.

After determination of the initial fracture gradient 200, the drilling fluid temperature may then be increased at about last casing shoe 45 to an elevated temperature. Elevated temperatures at about last casing shoe 45 include temperatures higher than conventional drilling fluid temperature 305 to about equal to the static temperature at about last casing shoe 45. Point 310 on FIG. 3 represents the drilling fluid temperature when it is increased to an elevated temperature about equal to static temperature at about last casing shoe 45.

The drilling fluid temperature may be increased by any method or combination of methods that add head to or reduce heat loss from the circulation system. The circulating system may comprise mud pits, mud pumps, piping, well control equipment, auxiliary equipment, drill string 20, wellbore 10, drilling fluid, the surrounding environment to the extent that the environment affects drilling fluid temperatures, and the like. Heat addition methods, which add heat to the circulation system, comprise heat exchangers, high pressure pumping, varying circulation rates of the drilling fluid, changes in the drilling fluid composition, mixing equipment, chemicals, increased drill string rotation, nuclear energy and the like. The chemicals can be added to the drilling fluid for the purpose of reacting exothermically and may include various acids and any other suitable chemicals. The reactant chemicals may be applied to the drilling fluid in wellbore 10, at surface 15, or both. Changes in the drilling fluid composition may be accomplished by densifiers, viscosifiers, chemicals, base fluids and the like. The mixing equipment comprises agitators, jet lines, hoppers, blenders and the like. Heat loss reduction methods, which reduce heat loss from the circulating system, may comprise high efficiency power systems, changing thermal properties of the circulating system, environmental isolation systems, and the like. High efficiency power systems are well known and may include any such suitable systems. Changing thermal properties of the drilling fluid may comprise any compositional or property change that affects heat capacity and other thermal properties, and the like. Changing thermal properties of wellbore 10 may comprise using insulation materials or different materials with varying thermal properties and the like. Insulation material may be applied in wellbore 10, at surface 15, or both. The insulation may be positioned so as to limit heat loss from the drilling fluid. For instance, the insulation may be applied to surface tanks (not illustrated) that hold the surface volume of the drilling fluid. Insulation may also be applied to tubulars (not illustrated) that conduct the circulating drilling fluid. Moreover, insulation may also be applied to last casing string 25, next casing string 30, and the like. In addition, insulation can be applied to the drilling riser for a deep water well. The insulation is preferably but not necessarily applied before the temperature of the drilling fluid is increased. Environmental isolation systems may comprise wind barriers, ocean current barriers, enclosed mud pits, and the like.

With the drilling fluid temperature at an elevated temperature at about last casing shoe 45, a second leak-off-test is preferably performed at about last casing shoe 45. The results of the second leak-off-test provide an elevated fracture gradient 205 (FIG. 2). Elevated fracture gradient 205 represents the fracture gradient determined at about last casing shoe 45 when the elevated drilling fluid temperature at about last casing shoe 45 is about equal to static temperature at about last casing shoe 45, represented by point 310 on FIG. 3. It is to be understood that elevated fracture gradient 205 at about last casing shoe 45 can be at any hypothetical equivalent density from higher than initial fracture gradient 200 at P5 to equal to about P6, depending on the temperature to which the drilling fluid is increased. It is also to be understood that when elevated fracture gradient 205 is determined at elevated drilling fluid temperatures at about equal to static temperature, the result represents the maximum drilling fluid density that can exist in wellbore 10 with the drilling fluid in a static condition without exceeding elevated fracture gradient 205. It is to be further understood that when the drilling fluid is at this maximum density in a dynamic condition, that the dynamic pressure of the circulated drilling fluid would exceed elevated fracture gradient 205. In alternative embodiments, elevated fracture gradient 205 is determined without increasing the drilling fluid to an elevated temperature.

After determining initial fracture gradient 200 and elevated fracture gradient 205 for formation 32, drill string 20 can be advanced into formation 32 with the drilling fluid temperature at the conventional drilling fluid temperature, as represented by the temperature at point 305. As drill string 20 drills into formation 32, the drilling fluid temperature at about last casing shoe 45 may be determined. In addition, the ECD may be determined at about last casing shoe 45 as drill string 20 drills deeper into wellbore 10. Data from pressure sensors (not illustrated) may be used to measure the ECD or an ECD can be determined using known formulas. Drill string 20 continues to advance in wellbore 10 until the determined ECD is about equal to or within a desired range of initial fracture gradient 200, as represented by point 240 in FIG. 2. The drilling fluid temperature may then be increased by at least one of the heat addition and heat loss reduction methods to increase the drilling fluid temperature at about last casing shoe 45 to an elevated temperature. Point 310 represents such an elevated temperature. As drill string 20 continues drilling with the drilling fluid at the elevated temperature, the ECD may again be determined at about last casing shoe 45. Downhole temperature sensors and thermodynamic, heat, and mass transfer calculations may determine the circulating temperature at about last casing shoe 45.

The temperature of the drilling fluid may be maintained at the elevated temperature at about last casing shoe 45 by an automated system (not illustrated). The automated system may use downhole and surface data to vary the heat applied to the drilling fluid so as to maintain the temperature at about last casing shoe 45 at about the elevated temperature. Such data may comprise temperature and pressure readings from surface and downhole equipment, drilling fluid properties and flow rate, wellbore equipment data, cementing data, surface and downhole equipment operating parameters and specifications, and the like. The automated system may comprise computer hardware and software, equipment control systems and the like. Control systems may use any combination of electric, electronic, hydraulic, pneumatic, or electro hydraulic controls. The computer software may process the data, perform calculations, and may indicate to the control system whether to adjust the drilling fluid temperature to maintain the circulating temperature. Computer software for performing temperature calculations is well known in the art and may comprise Wellcat™ and the like. It is to be further understood that the drilling fluid temperature can be increased by the automated system.

The drill string 20 may continue to advance with the drilling fluid at about the elevated temperature at about last casing shoe 45 until the calculated ECD at about last casing shoe 45 is about equal or within a desired range of elevated fracture gradient 205, as represented by point 250 at a depth of about D4. At this depth, next casing string 30 may then be set. To drill at deeper depths and set additional casing strings, the same procedures are preferably used as drill string 20 drills into open wellbore section 40 below next casing shoe 55. Additional casing strings may be set according to the same procedures until a desired wellbore depth is attained. For instance, the additional casing strings may be set using initial fracture gradients with conventional drilling fluid temperatures and/or elevated fracture gradients with elevated temperatures.

Figure 4:
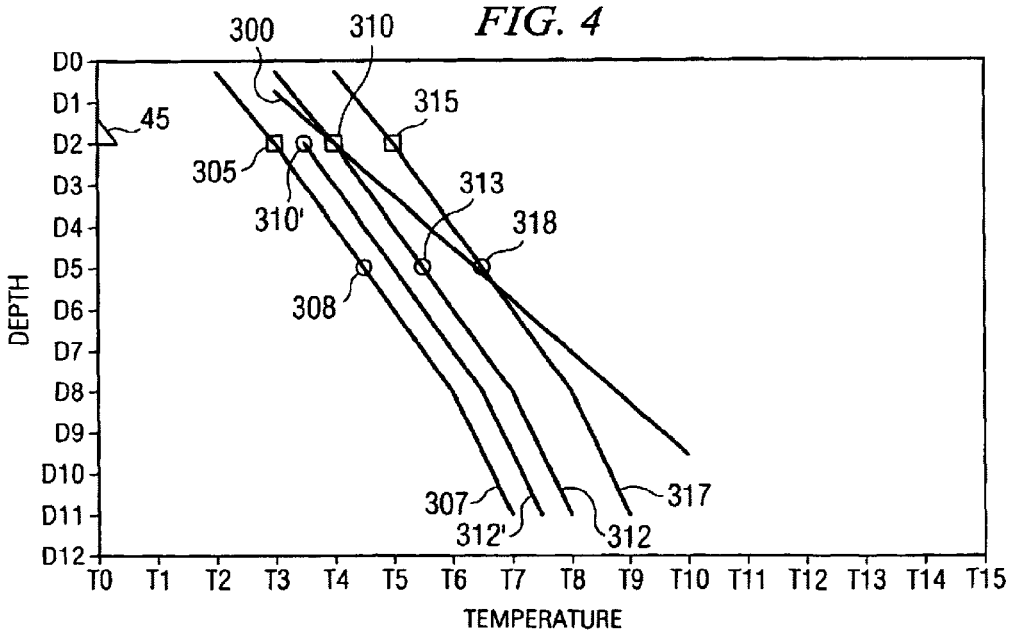
FIG. 4 illustrates the hypothetical temperature versus wellbore depth profile of FIG. 3 with more than one elevated temperature profile.
Figure 5:
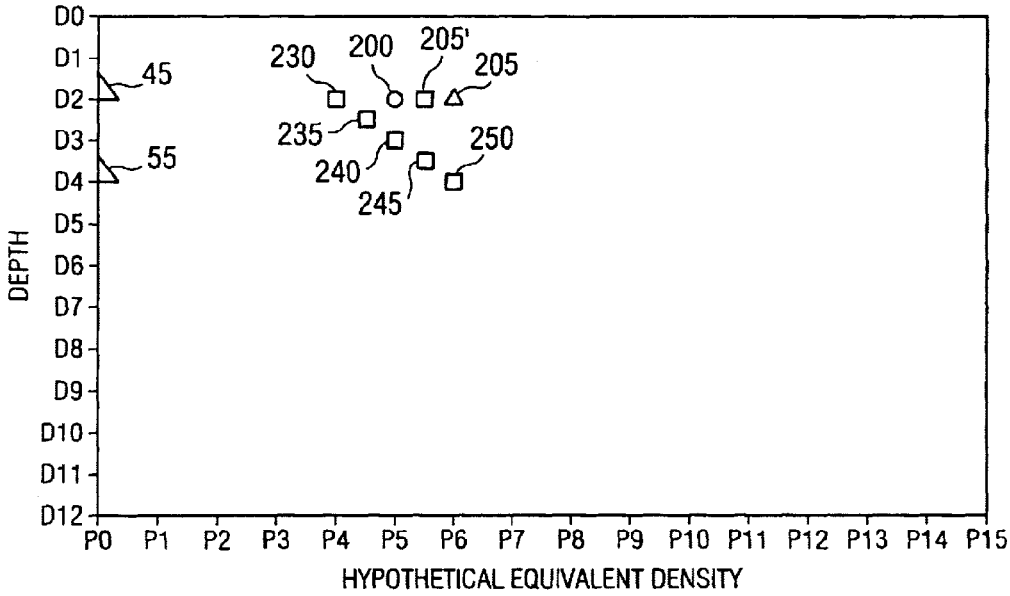
FIG. 5 illustrates the hypothetical equivalent density versus wellbore depth profile of FIG. 2 with more than one elevated fracture gradient.

In alternative embodiments, more than one elevated drilling fluid temperature profile and more than one elevated fracture gradient are used to set next casing string 30. The present invention includes increasing the drilling fluid temperature at about last casing shoe 45 to any desired number of elevated temperatures less than or equal to about static temperature at about last casing shoe 45 and also comprises determining more than one elevated fracture gradient at about last casing shoe 45. For instance, FIGS. 4 and 5 illustrate embodiments using elevated drilling fluid temperature profiles 312 and 312' and elevated fracture gradients 205 and 205'. In such embodiments, after initial fracture gradient 200 is determined, the drilling fluid temperature at about last casing shoe 45 is increased to elevated drilling fluid temperature 310', resulting in elevated drilling fluid temperature profile 312'. Elevated fracture gradient 205' is then determined. After determining elevated fracture gradient 205', the drilling fluid temperature can then be increased at about last casing shoe 45 to elevated drilling fluid temperature 310, resulting in elevated drilling fluid temperature profile 312. Elevated fracture gradient 205 is then determined. Therefore, when drilling below last casing shoe 45 with the drilling fluid at about last casing shoe 45 at conventional drilling fluid temperature 305, the drilling fluid temperature is increased to elevated drilling fluid temperature 310' at about last casing shoe 45 when the ECD at about last casing shoe 45 is about equal to or within a desired range of initial fracture gradient 200. Wellbore 10 can then be drilled at further depths with the drilling fluid at elevated drilling fluid temperature 310' at about last casing shoe 45 until the ECD at about last casing shoe 45 is about equal to or within a desired range of elevated fracture gradient 205'. Next casing string 30 can then be set or drilling can proceed in wellbore 10 at further depths with the drilling fluid increased to elevated drilling fluid temperature 310 at about casing shoe 45.

Figure 6:
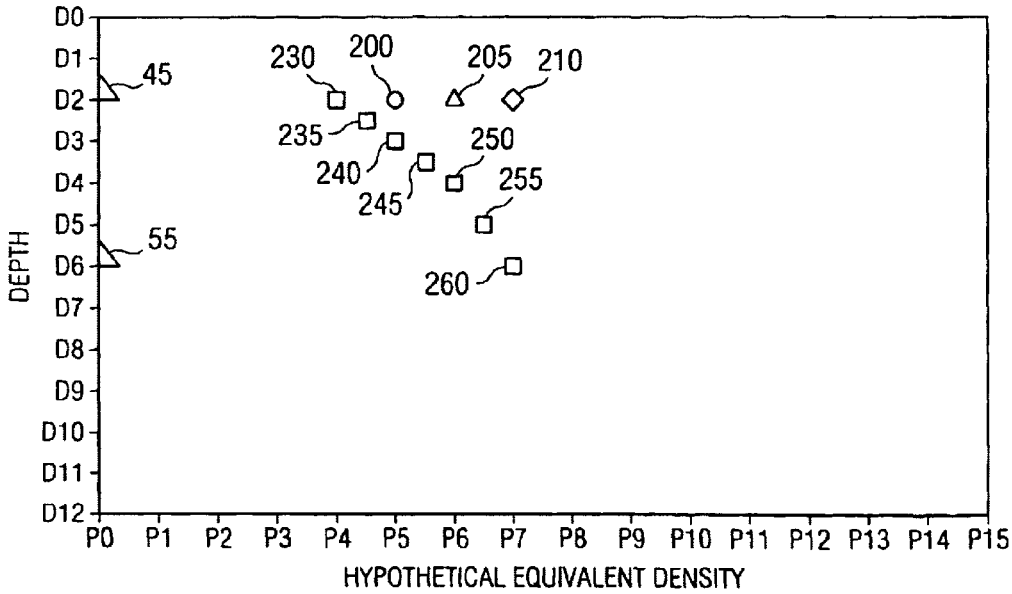
FIG. 6 illustrates a hypothetical equivalent density v. wellbore depth profile showing an initial fracture gradient, an elevated fracture gradient, and a super-static fracture gradient.

FIG. 6 shows a further embodiment of the invention in which initial fracture gradient 200, elevated fracture gradient 205, and a super-static fracture gradient 210 are used to extend the window of operational pressure still further. In this embodiment, the drilling fluid is increased to a super-static drilling fluid temperature after determining fracture gradients 200 and 205. Super-static fracture gradient 210 is determined, and next casing string 30 is set when the ECD is about equal or within a desired range of super-static fracture gradient 210. Individual points 230, 235, 240, 245, 250, 255 and 260 represent the ECDs at about last casing shoe 45 for a circulating drilling fluid in a wellbore of increasing depth. The densities, depths, ECDs and fracture gradient designations are representative only and do not limit the invention.

The following describes an exemplary application of the present invention as embodied and illustrated in FIGS. 1, 3, and 6, which comprises substantially all of the elements of the above-discussed embodiments as illustrated in FIGS. 1 to 5 and alternative embodiments thereof, with the additional elements discussed below. After determination of initial fracture gradient 200 and elevated fracture gradient 205, super-static fracture gradient 210 can be determined, preferably by increasing the temperature of the drilling fluid at about last casing shoe 45 to a desired super-static temperature. The drilling fluid temperature can then be increased to the desired super-static temperature at about last casing shoe 45 by heat addition and/or heat loss reduction methods. The desired super-static temperature may be a temperature at point 315 on FIG. 3 or any other suitable temperature above the static temperature at about last casing shoe 45. A third leak-off-test is preferably performed at about last casing shoe 45 to determine super-static fracture gradient 210 (FIG. 4). Alternatively, the fracture gradients can be determined by known methods without increasing the drilling fluid temperature. In other alternative embodiments, more than one elevated fracture gradient and/or more than one super-static fracture gradient can be determined. It is to be understood that the invention is not limited to determining the fracture gradients at about the last casing shoe but also includes determining fracture gradients at desired depths lower in wellbore 10.

After determination of the fracture gradients, drill string 20 can then be advanced into formation 32 with the drilling fluid temperature at the conventional drilling fluid temperature, as represented by the temperature at point 305. The drilling fluid temperature is then increased to the elevated temperature 310 at about last casing shoe 45 when the ECD is about equal to or within a desired range of initial fracture gradient 200, as represented by point 240. Drill string 20 then continues to advance with the drilling fluid at the elevated temperature at about last casing shoe 45 until the ECD at about last casing shoe 45 is about equal to or within a desired range of elevated fracture gradient 205, as represented by point 250. The drilling fluid temperature may then be increased by at least one of the heat addition and heat loss reduction methods to increase the drilling fluid temperature at about last casing shoe 45 to the desired super-static temperature at about last casing shoe 45, which may be represented by point 315. In alternative embodiments, the drilling fluid temperature is increased to elevated drilling fluid temperature 310' and drill string 20 continues to advance until the ECD at about last casing shoe 45 is equal to or within a desired range of elevated fracture gradient 205', at which point the drilling fluid at about last casing shoe 45 is increased to the desired super-static drilling fluid temperature. The desired super-static temperature may be a temperature at point 315 in FIG. 3 or any other suitable temperature above the static temperature at about last casing shoe 45. As drilling continues with the drilling fluid at the super-static temperature, the ECD may then be determined at about last casing shoe 45. Downhole temperature sensors and thermodynamic, heat transfer, and mass transfer calculations may determine the circulating temperature at about last casing shoe 45. The temperature of the drilling fluid may be controlled by the automated system (not illustrated) to maintain the drilling fluid temperature at about last casing shoe 45 at about the desired super-static temperature. It is to be understood that the automated system can be used to increase the drilling fluid temperature to the elevated and/or super-static temperatures.

Drill string 20 may continue to advance with the drilling fluid at about the desired super-static temperature at about last casing shoe 45 until the ECD at about last casing shoe 45 is equal to or within a desired range of super-static fracture gradient 210, as represented by point 260 at a depth of about D6. At this depth, next casing string 30 may then be set. In alternative embodiments, the drilling fluid temperature at about last casing shoe 45 is further increased to at least one higher super-static temperature, with the drilling proceeding until the ECD at about last casing shoe 45 is about equal to or within a desired range of the super-static fracture gradient for such higher super-static temperature. To drill at deeper depths and set additional casing strings, the same procedures are preferably used as drill string 20 drills into open wellbore section 40 below next casing shoe 55. Additional casing strings below next casing shoe 55 may be set according to the same procedures until a desired wellbore depth may be attained. Alternatively, the additional casing strings may be set at depths when the ECD at about next casing shoe 55 or succeeding casing shoes is equal to or within a desired range of elevated fracture gradient 205, with the drilling fluid temperature at about next casing shoe 55 or the succeeding casing shoes at about the elevated temperature, and/or equal to or within a desired range of initial fracture gradient 200, with the drilling fluid temperature at about next casing shoe 55 or succeeding casing shoes at about the conventional drilling fluid temperature. In other alternatives, the additional casing strings may be set using at least one of elevated fracture gradients and super-static fracture gradients, with the drilling fluid temperature at succeeding casing shoes at about the elevated temperature and the super-static temperature, respectively. Further alternatives include using a plurality of super-static fracture gradients to set next casing string 30 and/or succeeding casing strings.

In alternative embodiments (not illustrated), super-static fracture gradient 210 is determined after determination of initial fracture gradient 200, without determination of elevated fracture gradient 205. In such an alternative embodiment, after the leak-off-test to determine initial fracture gradient 200 is performed, super-static fracture gradient 210 is determined, preferably by increasing the drilling fluid temperature from the conventional drilling fluid temperature to the desired super-static temperature at about last casing shoe 45. A leak-off-test is preferably performed to determine super-static fracture gradient 210. Moreover, when the ECD at about last casing shoe 45 is equal to or within a desired range of initial fracture gradient 200 as the drilling proceeds below last casing shoe 45, the temperature of the drilling fluid can be increased to the desired super-static temperature at about last casing shoe 45. The drilling can then proceed until the ECD at about last casing shoe 45 is about equal to or within a desired range of super-static fracture gradient 210, which is represented by point 260 at a depth of D6. At such a depth, next casing string 30 may be set. It is to be understood that additional casing strings may be set using initial fracture gradients, elevated fracture gradients, and/or super-static fracture gradients and their respective drilling fluid temperatures.

It is to be understood that the present invention is not limited to determining all fracture gradients prior to commencing drilling below last casing shoe 45. Elevated and/or super-static fracture gradients can be determined after drilling has commenced below last casing shoe 45. For instance, initial fracture gradient 200 can be determined at about last casing shoe 45 and drilling can commence below last casing shoe 45. Elevated and/or super-static fracture gradients can be determined when drill string 20 is at any wellbore depth, preferably when the ECD at about last casing shoe 45 is about equal to or within a desired range of initial fracture gradient 200. Super-static fracture gradient 210 can also be determined when the ECD at about last casing shoe 45 is about equal to or within a desired range of elevated fracture gradient 205. The same procedures apply when drill string

20 initially commences drilling below last casing shoe 45 with the drilling fluid temperature at static or super-static temperature at about last casing shoe 45. In embodiments comprising drilling using more than one elevated temperature and fracture gradient and/or more than one super-static temperature and fracture gradient, the same procedures apply and the fracture gradients can be determined at any suitable point.

The invention is not limited to adding heat from the heat addition methods when the ECD is equal to or within a desired range of a fracture gradient. Alternative embodiments (not illustrated) include adding heat at any desired point before or after drilling below the last casing shoe. The invention is further not limited to conducting the leak-off-tests at about the last casing shoe. Instead, alternative embodiments (not illustrated) include conducting the leak-off-tests at any suitable point in wellbore 10.

The above discussion is meant to be illustrative of the principles and various embodiments of the present invention. Numerous variations and modifications will become apparent to those skilled in the art once the above disclosure is fully appreciated. For instance, a further alternative embodiment (not illustrated) may comprise increasing the drilling fluid temperature at about last casing shoe 45 to the desired super-static drilling fluid temperature before commencing drilling below last casing shoe 45. Drill string 20 then drills into wellbore 10 at increasing depths with the drilling fluid at about last casing shoe 45 at the desired super-static temperature, without drilling at increasing depths at a conventional and/or elevated temperature. Next casing string 30 may then be set when the ECD at about last casing shoe 45 is equal to or within a desired range of super-static fracture gradient 210. An additional alternative embodiment (not illustrated) may comprise beginning to drill into wellbore 10 below last casing shoe 45 at a drilling fluid temperature at about last casing shoe 45 at an elevated temperature. Drill string 20 then drills into wellbore 10 at increasing depths with the drilling fluid at about last casing shoe 45 at the elevated temperature, without drilling at increasing depths at the conventional temperature. Next casing string 55 may then be set when the ECD is equal to or within a desired range of elevated fracture gradient 205. A further alternative embodiment comprises increasing the drilling fluid temperature at about last casing shoe 45 to an elevated temperature before drilling below last casing shoe 45. Drill string 20 then drills into wellbore 10 at increasing depths with the drilling fluid at about last casing shoe 45 at the elevated temperature, without drilling at increasing depths at the conventional temperature. When the ECD is equal to or within a desired range of elevated fracture gradient 205 at about last casing shoe 45, the temperature of the drilling fluid can be increased to a desired super-static temperature at about last casing shoe 45. The drilling can then proceed until the ECD at about last casing shoe 45 is equal to or within a desired range of super-static fracture gradient 210, which is represented by point 260 at a depth of D6. At such a depth, next casing string 30 may then be set. It is to be understood that additional casing strings below next casing string 30 can be set using any desired combination of conventional, elevated, and/or super-static fracture gradients and their respective drilling fluid temperatures. It is to be further understood that the embodiments and description are illustrative and not limiting of the invention.

What is claimed is:

1. A method for drilling a wellbore in a formation using a drilling fluid, wherein the drilling fluid has a first temperature, and wherein the wellbore has a first wellbore depth, the method comprising:

(A) determining at least one fracture gradient, wherein the fracture gradient is determined at about the first wellbore depth;

(B) increasing the temperature of the drilling fluid from the first temperature to a desired temperature at about the first wellbore depth;

(C) drilling into the formation at increasing wellbore depths below the first wellbore depth, wherein at least one equivalent circulating density of the drilling fluid is determined at about the first wellbore depth; and (D) setting a casing string at a depth at which the equivalent circulating density is about equal to or within a desired range of a fracture gradient.

2. The method of claim 1, wherein the fracture gradient of step (A) comprises at least one of an elevated fracture gradient and a super-static fracture gradient.

3. The method of claim 1, wherein step (A) further comprises using a leak-off-test to determine the at least one fracture gradient at about the first wellbore depth.

4. The method of claim 1, wherein step (B) is accomplished by at least one of heat addition methods and heat loss reduction methods.

5. The method of claim 4, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

6. The method of claim 4, wherein the heat loss reduction methods are selected from at least one of the group consisting of: high efficiency power systems, changing thermal properties of a circulation system, and environmental isolation systems.

7. The method of claim 6, wherein step (B) further comprises adding insulation, wherein adding insulation comprises insulating a drilling riser for deep water wells.

8. The method of claim 1, wherein step (B) further comprises using an automated system to increase the temperature.

9. The method of claim 1, wherein the desired temperature of step (B) is an elevated temperature or a super-static temperature.

10. The method of claim 1, wherein step (C) further comprises using an automated system to maintain the temperature of the drilling fluid at about the first wellbore depth.

11. The method of claim 1, wherein step (C) further comprises increasing the temperature of the drilling fluid to a next desired drilling fluid temperature at about the first wellbore depth when the equivalent circulating density is about equal to or within a desired range of the fracture gradient at about the first wellbore depth, wherein the wellbore is further drilled at increasing depths with the drilling fluid at about the next desired drilling fluid temperature at about the first wellbore depth.

12. A method for drilling a wellbore in a formation using a drilling fluid to increase fracture gradients, wherein a casing string and a casing shoe are disposed in the wellbore, the method comprising:

(A) determining at least one fracture gradient at about the casing shoe, wherein an initial fracture gradient is determined at a conventional drilling fluid temperature, (B) drilling into the formation below the casing shoe at increasing depths with the drilling fluid at about the conventional drilling fluid temperature at about the casing shoe, and wherein at least one equivalent circulating density of the drilling fluid is determined at about the casing shoe;

(C) increasing the temperature of the drilling fluid at about the casing shoe to a desired drilling fluid temperature;

(D) drilling further into the wellbore at increasing depths with the drilling fluid at about the desired temperature at about the casing shoe, wherein at least one equivalent circulating density of the drilling fluid is calculated at about the casing shoe; and (E) setting a next casing string that extends from the casing string to a depth at which the equivalent circulating density at about the casing shoe is about equal to or within a desired range of a fracture gradient determined at about the casing shoe.

13. The method of claim 12, wherein step (A) further comprises using a leak-off-test at about the casing shoe to determine at least one fracture gradient at about the casing shoe.

14. The method of claim 12, wherein step (A) further comprises determining at least one elevated fracture gradient or at least one super-static fracture gradient at about the casing shoe.

15. The method of claim 12, wherein step (C) further comprises increasing the drilling fluid temperature at a depth when the equivalent circulating density is about equal to or within a desired range of the initial fracture gradient at about the casing shoe.

16. The method of claim 12, wherein step (C) further comprises increasing the temperature by at least one of heat addition methods and heat loss reduction methods.

17. The method of claim 16, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

18. The method of claim 16, wherein the heat loss reduction methods are selected from at least one of the group consisting of: high efficiency power systems, changing thermal properties of a circulation system, and environmental isolation systems.

19. The method of claim 18, wherein step (C) further comprises adding insulation, wherein adding insulation comprises insulating a drilling riser for deep water wells.

20. The method of claim 12, wherein step (C) further comprises determining at least one elevated fracture gradient or at least one super-static fracture gradient.

21. The method of claim 12, wherein the desired drilling fluid temperature of step (C) is an elevated temperature or a super-static temperature.

22. The method of claim 21, wherein the formation has a static temperature profile comprising a plurality of static temperatures at wellbore depths, and wherein the elevated temperature is a drilling fluid temperature from higher than conventional drilling fluid temperature to about equal to the static temperature at about casing shoe.

23. The method of claim 21, wherein the formation has a static temperature profile comprising a plurality of static temperatures at wellbore depths, and wherein the super-static temperature is a drilling fluid temperature higher than about the static temperature at about the casing shoe.

24. The method of claim 12, wherein step (C) further comprises using an automated system to increase the temperature.

25. The method of claim 12, wherein step (D) further comprises increasing the temperature of the drilling fluid to a next desired drilling fluid temperature at about the casing shoe when the equivalent circulating density is about equal to or within a desired range of a fracture gradient at about the casing shoe, wherein the wellbore is further drilled at increasing depths with the drilling fluid at about the next desired drilling fluid temperature at about the casing shoe.

26. The method of claim 12, wherein step (D) further comprises using an automated system to maintain the drilling fluid temperature at about the casing shoe.

27. The method of claim 12, wherein the fracture gradient of step (E) is an elevated fracture gradient or a super-static fracture gradient.

28. A method for drilling a wellbore in a formation using a drilling fluid, wherein a casing string and a casing shoe are disposed in the wellbore, wherein the drilling fluid has a first temperature, the method comprising:

(A) increasing the temperature of the drilling fluid to a desired temperature at about the casing shoe;

(B) determining at least one fracture gradient at the desired temperature, wherein the fracture gradient is determined at about the casing shoe;

(C) drilling into the formation at increasing wellbore depths below the casing shoe, wherein at least one equivalent circulating density of the drilling fluid is calculated at about the casing shoe; and (D) setting a next casing string at a depth at which the equivalent circulating density is about equal to or within a desired range of a fracture gradient determined at about the casing shoe.

29. The method of claim 28, wherein the desired temperature of step (A) is an elevated temperature or a super-static temperature.

30. The method of claim 29, wherein the formation has a static temperature profile comprising a plurality of static temperatures at wellbore depths, and wherein the elevated temperature is a drilling fluid temperature from higher than conventional drilling fluid temperature to about equal to the static temperature at about the casing shoe.

31. The method of claim 29, wherein the formation has a static temperature profile comprising a plurality of static temperatures at wellbore depths, and wherein the super-static temperature is a drilling fluid temperature higher than about the static temperature at about the casing shoe.

32. The method of claim 28, wherein step (A) further comprises increasing the temperature by at least one of heat addition methods and heat loss reduction methods.

33. The method of claim 32, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

34. The method of claim 32, wherein the heat loss reduction methods are selected from at least one of the group consisting of: high efficiency power systems, changing thermal properties of a circulation system, and environmental isolation systems.

35. The method of claim 34, wherein step (A) further comprises adding insulation, wherein adding insulation comprises insulating a drilling riser for deep water wells.

36. The method of claim 28, wherein step (A) further comprises using an automated system to increase the temperature.

37. The method of claim 28, wherein step (B) further comprises using a leak-off-test at about the casing shoe to determine at least one fracture gradient at about the casing shoe.

38. The method of claim 28, wherein step (C) further comprises using an automated system to maintain the drilling fluid temperature at about the casing shoe.

39. The method of claim 28, wherein the fracture gradient of step (B) is an elevated fracture gradient or a super-static fracture gradient.

40. The method of claim 28, wherein step (C) further comprises increasing the temperature of the drilling fluid to a next desired drilling fluid temperature at about the casing shoe when the equivalent circulating density is about equal to or within a desired range of a fracture gradient at about the casing shoe, wherein the wellbore is further drilled at increasing depths with the drilling fluid at about the next desired drilling fluid temperature at about the casing shoe.

41. The method of claim 28, wherein the fracture gradient of step (D) is an elevated fracture gradient or a super-static fracture gradient.

42. A method for drilling a wellbore in a formation using a drilling fluid to increase fracture gradients, wherein a casing string and a casing shoe are disposed in the wellbore, the method comprising:

(A) determining at least one fracture gradient at about the casing shoe, wherein an initial fracture gradient is determined at a conventional drilling fluid temperature, (B) drilling into the formation below the casing shoe at increasing depths with the drilling fluid at about the conventional drilling fluid temperature at about the casing shoe, and wherein at least one equivalent circulating density of the drilling fluid is determined at about the casing shoe;

(C) increasing the temperature of the drilling fluid at about the casing shoe to an elevated drilling fluid temperature;

(D) drilling further into the wellbore at increasing depths with the drilling fluid at about the elevated temperature at about the casing shoe, wherein at least one equivalent circulating density of the drilling fluid is calculated at about the casing shoe;

(E) increasing the temperature of the drilling fluid at about the casing shoe to a super-static drilling fluid temperature;

(F) drilling further into the wellbore at increasing depths with the drilling fluid at about the super-static temperature at about the casing shoe, wherein at least one equivalent circulating density of the drilling fluid is calculated at about the casing shoe; and (G) setting a next casing string that extends from the casing string to a depth at which the equivalent circulating density at about the casing shoe is equal to or within a desired range of a super-static fracture gradient determined at about the casing shoe.

43. The method of claim 42, wherein step (A) further comprises using a leak-off-test at about the casing shoe to determine at least one fracture gradient at about the casing shoe.

44. The method of claim 42, wherein step (A) further comprises determining at least one elevated fracture gradient and at least one super-static fracture gradient at about the casing shoe.

45. The method of claim 42, wherein step (A) further comprises determining at least one elevated fracture gradient or at least one super-static fracture gradient at about the casing shoe.

46. The method of claim 42, wherein step (C) further comprises increasing the drilling fluid temperature at a depth when the equivalent circulating density is about equal to or within a desired range of the initial fracture gradient at about the casing shoe.

47. The method of claim 42, wherein step (C) further comprises increasing the temperature by at least one of heat addition methods and heat loss reduction methods.

48. The method of claim 47, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

49. The method of claim 48, wherein the heat loss reduction methods are selected from at least one of the group consisting of: high efficiency power systems, changing thermal properties of a circulation system, and environmental isolation systems.

50. The method of claim 49, wherein step (C) further comprises adding insulation, wherein adding insulation comprises insulating a drilling riser for deep water wells.

51. The method of claim 42, wherein step (C) further comprises determining at least one elevated fracture gradient and at least one super-static fracture gradient.

52. The method of claim 42, wherein step (C) further comprises determining at least one elevated fracture gradient or at least one super-static fracture gradient.

53. The method of claim 42, wherein the formation has a static temperature profile comprising a plurality of static temperatures at wellbore depths, and wherein the elevated temperature of step (C) is a drilling fluid temperature from higher than conventional drilling fluid temperature to about equal to the static temperature at about the casing shoe.

54. The method of claim 42, wherein step (C) further comprises using an automated system to increase the temperature.

55. The method of claim 42, wherein step (D) further comprises increasing the temperature of the drilling fluid to a next elevated drilling fluid temperature at about the casing shoe when the equivalent circulating density is about equal to or within a desired range of an elevated fracture gradient at about the casing shoe, wherein the wellbore is further drilled at increasing depths with the drilling fluid at about the next elevated drilling fluid temperature at about the casing shoe.

56. The method of claim 42, wherein step (D) further comprises using an automated system to maintain the drilling fluid temperature at about the casing shoe.

57. The method of claim 42, wherein step (E) further comprises increasing the drilling fluid temperature at a depth when the equivalent circulating density is about equal to or within a desired range of an elevated fracture gradient at about the casing shoe.

58. The method of claim 42, wherein step (E) further comprises increasing the temperature by at least one of heat addition methods and heat loss reduction methods.

59. The method of claim 58, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

60. The method of claim 58, wherein the heat loss reduction methods are selected from at least one of the group consisting of: high efficiency power systems, changing thermal properties of a circulation system, and environmental isolation systems.

61. The method of claim 60, wherein step (E) further comprises adding insulation, wherein adding insulation comprises insulating a drilling riser for deep water wells.

62. The method of claim 42, wherein step (E) further comprises determining at least one super-static fracture gradient.

63. The method of claim 42, wherein the formation has a static temperature profile comprising a plurality of static temperatures at wellbore depths, and wherein the super-static temperature of step (E) is a drilling fluid temperature higher than about the static temperature at about the casing shoe.

64. The method of claim 42, wherein step (E) further comprises using an automated system to increase the temperature.

65. The method of claim 42, wherein step (F) further comprises increasing the temperature of the drilling fluid to a next super-static drilling fluid temperature at about the casing shoe when the equivalent circulating density is about equal to or within a desired range of a super-static fracture gradient at about the casing shoe, wherein the wellbore is further drilled at increasing depths with the drilling fluid at about the next super-static drilling fluid temperature at about the casing shoe.

66. The method of claim 42, wherein step (F) further comprises using an automated system to maintain the drilling fluid temperature at about the casing shoe.

67. A method for drilling a wellbore in a formation using a drilling fluid to increase fracture gradients, wherein a casing string and a casing shoe are disposed in the wellbore, wherein the drilling fluid has a first temperature, the method comprising:

(A) increasing the temperature of the drilling fluid to an elevated temperature at about the casing shoe;

(B) determining at least one fracture gradient at about the casing shoe, wherein at least one elevated fracture gradient is determined;

(C) drilling into the formation below the casing shoe at increasing depths with the drilling fluid at about the elevated temperature at about the casing shoe, and wherein at least one equivalent circulating density of the drilling fluid is determined at about the casing shoe;

(D) increasing the temperature of the drilling fluid at about the casing shoe to a super-static temperature;

(E) drilling further into the wellbore at increasing depths with the drilling fluid at about the super-static temperature at about the casing shoe, wherein at least one equivalent circulating density of the drilling fluid is calculated at about the casing shoe; and (F) setting a next casing string that extends from the casing string to a depth at which the equivalent circulating density at about the casing shoe is equal to or within a desired range of a super-static fracture gradient determined at about the casing shoe.

68. The method of claim 67, wherein the formation has a static temperature profile comprising a plurality of static temperatures at wellbore depths, and wherein the elevated temperature of step (A) is a drilling fluid temperature from higher than first temperature to about equal to the static temperature at about the casing shoe.

69. The method of claim 67, wherein step (A) further comprises increasing the temperature by at least one of heat addition methods and heat loss reduction methods.

70. The method of claim 69, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation; and (8) nuclear energy.

71. The method of claim 69, wherein the heat loss reduction methods are selected from at least one of the group consisting of: high efficiency power systems, changing thermal properties of a circulation system, and environmental isolation systems.

72. The method of claim 71, wherein step (A) further comprises adding insulation, wherein adding insulation comprises insulating a drilling riser for deep water wells.

73. The method of claim 67, wherein step (A) further comprises using an automated system to increase the temperature.

74. The method of claim 67, wherein step (B) further comprises using a leak-off-test at about the casing shoe to determine at least one fracture gradient at about the casing shoe.

75. The method of claim 67, wherein step (B) further comprises determining at least one elevated fracture gradient and at least one super-static fracture gradient at about the casing shoe.

76. The method of claim 67, wherein step (B) further comprises determining at least one elevated fracture gradient or at least one super-static fracture gradient at about the casing shoe.

77. The method of claim 67, wherein step (C) further comprises increasing the temperature of the drilling fluid to a next elevated drilling fluid temperature at about the casing shoe when the equivalent circulating density is about equal to or within a desired range of an elevated fracture gradient at about the casing shoe, wherein the wellbore is further drilled at increasing depths with the drilling fluid at about the next elevated drilling fluid temperature at about the casing shoe.

78. The method of claim 67, wherein step (C) further comprises using an automated system to maintain the drilling fluid temperature at about the casing shoe.

79. The method of claim 67, wherein step (D) further comprises increasing the drilling fluid temperature at a depth when the equivalent circulating density is about equal to or within a desired range of at least one elevated fracture gradient at about the casing shoe.

80. The method of claim 67, wherein step (D) further comprises increasing the temperature by at least one of heat addition methods and heat loss reduction methods.

81. The method of claim 80, wherein the heat addition methods are selected from at least one of the group consisting of:

(1) heat exchangers;

(2) high pressure pumping;

(3) varying circulation rates of the drilling fluid;

(4) changes in the drilling fluid composition;

(5) chemicals;

(6) mixing equipment;

(7) increased drill string rotation;

(8) nuclear energy.

82. The method of claim 80, wherein the heat loss reduction methods are selected from at least one of the group consisting of: high efficiency power systems, changing thermal properties of a circulation system, and environmental isolation systems.

83. The method of claim 82, wherein step (D) further comprises adding insulation, wherein adding insulation comprises insulating a drilling riser for deep water wells.

84. The method of claim 67, wherein the formation has a static temperature profile comprising a plurality of static temperatures at wellbore depths, and wherein the super-static temperature of step (D) is a drilling fluid temperature higher than about the static temperature at about the casing shoe.

85. The method of claim 67, wherein step (D) further comprises determining at least one super-static fracture gradient.

86. The method of claim 67, wherein step (D) further comprises using an automated system to increase the temperature.

87. The method of claim 67, wherein step (E) further comprises increasing the temperature of the drilling fluid to a next super-static drilling fluid temperature at about the casing shoe when the equivalent circulating density is about equal to or within a desired range of a super-static fracture gradient at about the casing shoe, wherein the wellbore is further drilled at increasing depths with the drilling fluid at about the next super-static drilling fluid temperature at about the casing shoe.

88. The method of claim 67, wherein step (E) further comprises using an automated system to maintain the drilling fluid temperature at about the casing shoe.

* * * * *